US005565847A

United States Patent [19]

Gambino et al.

[11] Patent Number: 5,565,847

[45] Date of Patent: Oct. 15, 1996

[54] MAGNETIC TAG USING ACOUSTIC OR MAGNETIC INTERROGATION

[75] Inventors: Richard J. Gambino, Stony Brook; Alejandro G. Schrott; Robert J. von Gutfeld, both of New York, all of N.Y.

[73] Assignee: International Business Machines Corporation, Armonk, N.Y.

[21] Appl. No.: 344,296

[22] Filed: Nov. 23, 1994

[51] Int. Cl.[6] ..... G08B 13/14

[52] U.S. Cl. ..... 340/572; 333/227

[58] Field of Search ..... 340/572, 825.31, 340/825.32, 825.33, 825.34, 551; 333/219.2, 227; 235/380, 381, 382, 382.5, 385

[56] References Cited

U.S. PATENT DOCUMENTS

| | | | |
|---|---|---|---|
| 4,341,189 | 7/1982 | Yamaguchi et al. | 73/651 X |
| 4,465,047 | 8/1984 | Yamaguchi et al. | 73/651 X |
| 4,510,490 | 4/1985 | Anderson, III et al. | 340/572 |
| 4,622,543 | 11/1986 | Anderson, III et al. | 340/572 |
| 4,727,360 | 2/1988 | Ferguson et al. | 340/572 |
| 4,882,569 | 11/1989 | Dey | 340/572 |
| 4,940,966 | 7/1990 | Pettigrew et al. | 340/551 |
| 4,999,609 | 3/1991 | Crossfield | 340/551 |
| 5,001,458 | 3/1991 | Tyrén et al. | 340/551 |
| 5,001,933 | 3/1991 | Brand | 73/651 |
| 5,055,786 | 10/1991 | Wakatsuki et al. | 324/207.21 X |
| 5,166,612 | 11/1992 | Murdock | 324/207.13 |
| 5,414,412 | 5/1995 | Lian | 340/572 |
| 5,420,569 | 5/1995 | Dames et al. | 340/572 |

FOREIGN PATENT DOCUMENTS

| | | | |
|---|---|---|---|
| 8903200 | 7/1991 | Niger | 340/551 |

*Primary Examiner*—Thomas Mullen

*Attorney, Agent, or Firm*—Whitham, Curtis, Whitham & McGinn; Stephen S. Strunck, Esq.

[57] ABSTRACT

A tag structure suitable for attachment to an object and for being remotely sensed, includes at least one soft magnetic element mounted for being excited in an inhomogeneous magnetic field. The soft magnetic element includes first and second ends and is clamped at at least one of the first and second ends. Each soft magnetic element responds to the excitation to produce a unique, time-varying magnetic field corresponding to its resonant frequency, when excited. A system incorporating the tag includes an excitation device and a detector for detecting the mechanical vibrations of the soft magnetic element.

20 Claims, 4 Drawing Sheets

$f_i$ : RESONANT FREQUENCY OF CANTILEVER i

MAGNETIC TAG USING ACOUSTIC OR MAGNETIC INTERROGATION

BACKGROUND OF THE INVENTION

1. Field of the Invention

The present invention generally relates to a multibit tag useful for object identification having an array of cantilevers, and more particularly to a tag having a novel form of cantilever preferably fabricated from a thin strip of soft magnetic material such as Metglas™ or the like preferably separated by a thin space from a small sheet of hard magnetic material.

Further, the present invention relates to tags that use acoustic excitation in conjunction with one or more strips of soft magnetic material, having both ends unclamped or having both ends clamped.

2. Cross-reference to Related Applications

The invention disclosed and claimed herein is related to the inventions disclosed and claimed in co-pending applications Ser. Nos. 08/344,808, 08/344,771, and 08/344,196.

3. Description of the Related Art

For retail tagging, tagging used in the road/air-freight package industry, and pallet tagging in manufacturing processes, a tag is required for identifying a product in detail. With a sufficient number of bits, the tag can be interrogated to determine what the product is, when it was manufactured, its price, whether the product has been properly passed through a check-out counter or kiosk, etc. Tags are also useful in identifying personnel as well as a variety of other animate and inanimate objects.

Thus, tags are useful in retailing, shipping, manufacturing and many other kinds of businesses. A number of different magnetic tag configurations are presently of interest for inventory, theft control and personnel identification. Acoustic excitation is attractive as it tends to be less directional than electromagnetic excitation used conventionally. Many conventional sensors also require power sources as part of the structure and some operate only at low temperatures.

In one conventional tag, a vibration sensor includes one or more cantilevers tuned to resonate at predetermined frequencies. The cantilever vibration causes a gap to be closed which allows current to flow through the cantilever to a microchip and an integrated circuit mounted on the base of the device. Thus, this device requires a power source, wiring, current flow through the device for sensing and an integrated circuit, all of which are part of the tag structure.

Another conventional tag has a plurality of cantilevers, with each cantilever having its own superconducting quantum interference device (SQUID) detector mounted in close proximity to a miniature cantilever. Current must flow through the cantilever. The current supplies the magnetic field which results in a change in flux when the cantilever vibrates. The SQUIDS necessarily make this a low temperature device, i.e. at least as low as liquid nitrogen, though more likely liquid Helium (4 degrees Kelvin). This device does not provide for remote sensing and furthermore requires an onboard power source. Additionally, sensing coils on the device operate only at low temperatures.

Other sensing elements are known in which engine knocking is detected with a feedback mechanism for adjusting the timing to reduce the knocking. Vibrating cantilever elements are used which are either magnetic or piezoelectric. Sensing for the piezoelectric elements is obtained by a current output at the resonant frequency. With the magnetic elements, a change in the reluctance path is detected by a coil wrapped around the core of the magnetic circuit comprising the device. Sensing is part of the device and is not achieved remotely. The excitation is mechanical vibration leading to cantilever resonance since the device is secured to the engine block.

Additionally, a single "bit" resonator is known in which a resonating element is an integral part of the resonator structure, consisting of a magnetostrictive membrane. Magnetic excitation is required, giving rise to an acoustic signal that can be detected remotely.

Thus, the invention provides inexpensive multibit tags different from those which rely on the magnetostrictive effect and are magnetically interrogated. Magnetic tags are generally less expensive than the more conventional radio frequency (RF) tags containing integrated circuits. As mentioned above, the magnetic tags can be used in a variety of different applications, including anti-theft, identification and retail applications.

SUMMARY OF THE INVENTION

It is therefore an object of the present invention to provide a multibit tag having an array of cantilevers.

Another object is to provide a novel form of cantilever fabricated from a thin strip of soft magnetic material such as Metglas™, permalloy, or the like, separated by a thin space from a small sheet of hard magnetic material to form a cantilever of the multibit tag.

Yet another object is to provide a tag which uses acoustic excitation in conjunction with one or more strips of Metglas or the like which are preferably clamped at first and second ends.

A further object of the present invention is to provide a system and method of using acoustic excitation in a magnetic multibit tag.

In a first aspect of the invention, a magnetic tag for remote sensing is provided which includes at least one element of a soft magnetic material, means for supplying an inhomogeneous magnetic field around said element, each at least one magnetic element preferably being mounted within a Helmholtz resonator for responding to respective resonances of at least one magnetic element to produce respective unique time varying magnetic fields corresponding to the resonances, when excited by acoustic excitation. Herein, the resonances are mechanical in nature and correspond to vibrational modes in a direction normal to the plane of the element.

In a second aspect of the invention, a single or multibit magnetic tag, preferably for mounting on a Helmholtz resonator for enhancing a mode of vibration, is provided which includes at least one soft magnetic element, the at least one element having first and second ends, with both first and second ends being free or at least one of the first and second ends being clamped to form an assembly wherein with one end clamped said element is a cantilever and further including a hard magnet mounted near said at least one element, or other means, for supplying an inhomogeneous field around said at least one magnetic element.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Generally, the present invention includes several concepts to yield several new types of magnetic single or multibit tags. As mentioned above, such tags are useful for inventory control, identification of objects, people, theft control, etc.

As discussed in further detail below, the device includes a cantilever fashioned from a thin piece of ferromagnetic material, highly permeable but with low coercivity known in the art as soft magnetic material, such as Metglas™ (e.g., Fe—Co based amorphous metal ribbon) which is commercially available from Allied Signal Corporation. The material need not be magnetostrictive as is often required by many conventional magnetic tags.

Figure 1:
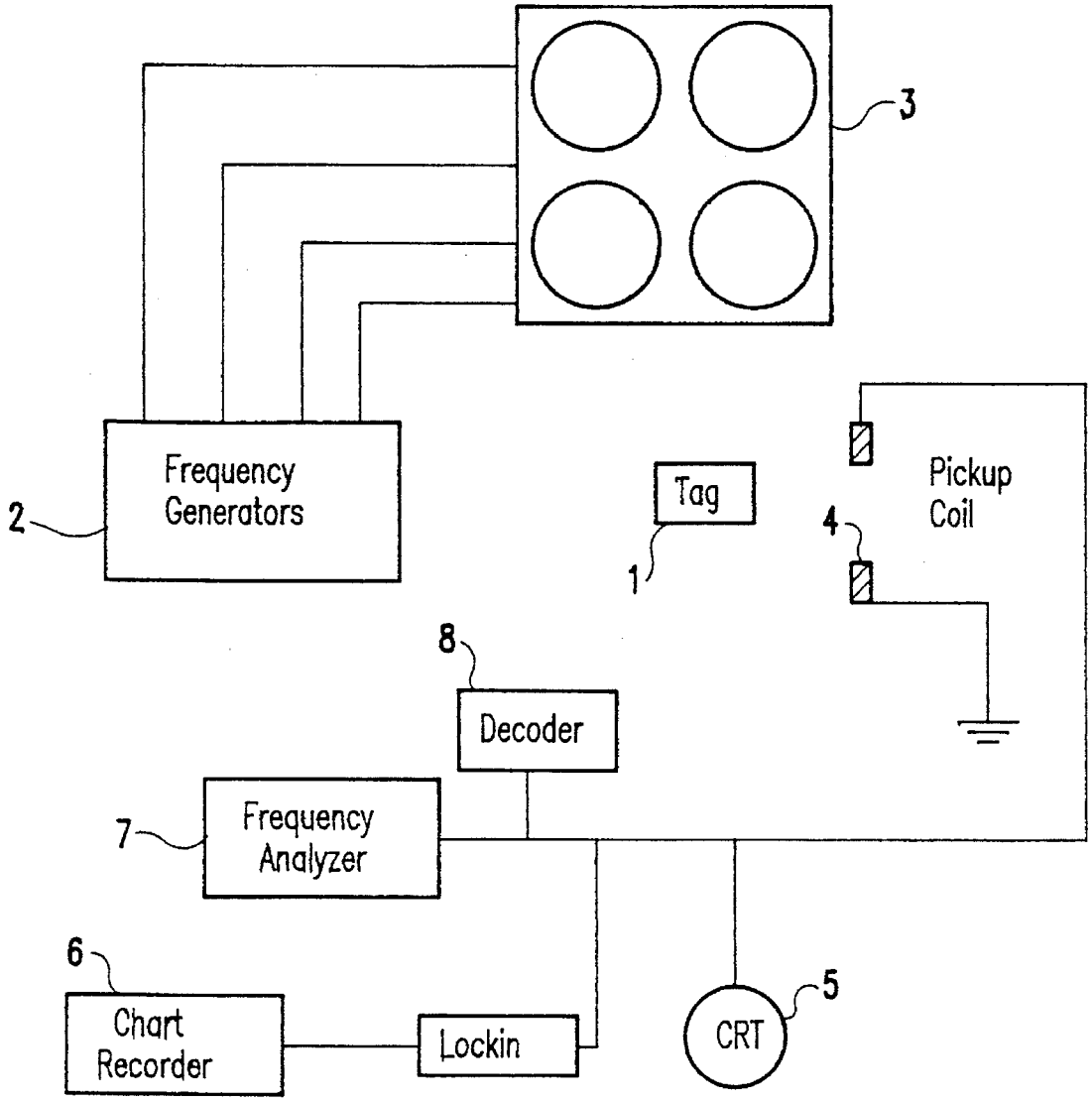
FIG. 1 is an exemplary detection/interrogation system employing the tag according to the present invention.

FIG. 1 illustrates an exemplary system in which the magnetic tag 1 of the invention is utilized. The system includes frequency generators 2 which drive an array of speakers 3 for generating predetermined acoustic energy waves from respective ones of the speakers having a predetermined frequency (e.g., ≈20 Hz–20 kHz), however, clearly any range of predetermined frequencies may be employed. The acoustic energy is for interrogating the tag, typically affixed to an animate or inanimate object, by causing one or more elements in the tag to begin resonating at their respective resonant frequencies. The output from the one or more elements is received by a pickup (e.g., receiving) coil 4. Thereafter, the output from coil 4 is input to an output/display device such as a cathode ray tube (CRT) 5, a chart recorder 6 (via a lock-in device), a frequency analyzer 7, and/or a suitable decoding device 8. With the invention, based on the detected frequency code generated by the tag, decoding or interpretation of the code can be accomplished by the decoder 8. The structure of the decoder 8 is known in the art and includes, for example, an interface between the coil 4 and a suitable processor including such known circuitry as an A/D converter, suitable signal condition/processing circuitry, lookup tables and logic circuitry. Thus, a predetermined code encoded on the tag 1 can be detected.

Figure 2A:
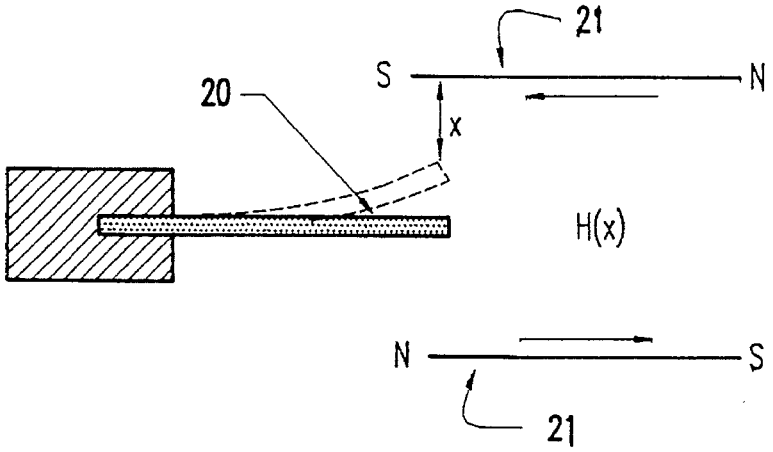
FIG. 2A illustrates a cantilever oscillating in a region of a nonuniform magnetic field.
Figure 2B:
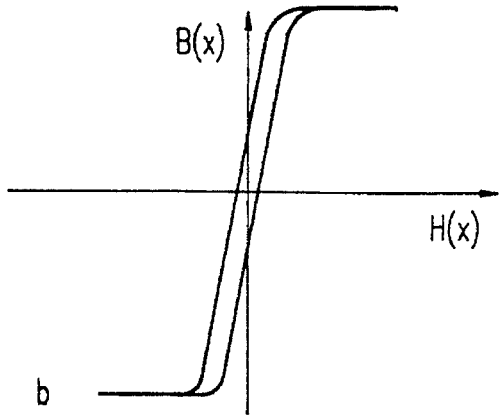
FIG. 2B illustrates a variation of the magnetic induction in the cantilever of soft magnetic material due to the variation in distance to hard magnets.
Figure 2C:
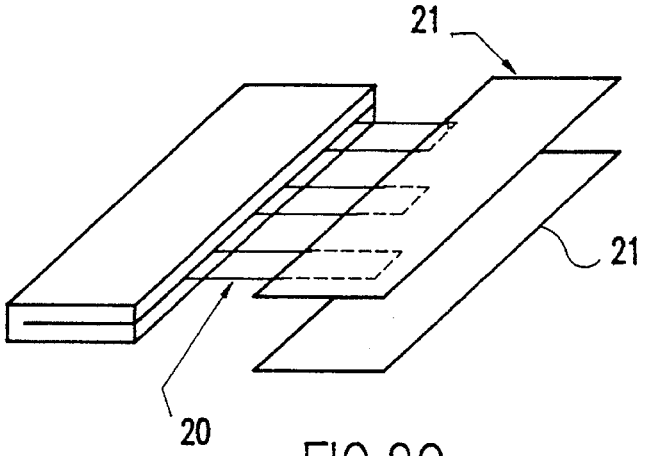
FIG. 2C illustrates a perspective view of the tag according to the invention, with an array of cantilevers biased by a hard magnet.

Looking at the structure of the tag in greater detail and referring to FIGS. 2A–2C, the tag includes, herein illustrated for a plurality of cantilevers, cantilevers 20 having a different length and/or thickness from one another. Each cantilever is predetermined, thereby to resonate at a predetermined resonant frequency.

The cantilever is assembled by positioning it near means for supplying an inhomogeneous magnetic field H(x) around said one or more elements, here being a hard magnetic material comprising a magnetized ferromagnet 21, such as cobalt or Fe, as shown in FIGS. 2A and 2C. Alternatively, the inhomogeneous magnetic field may be supplied by an external field as, for example, from a current carrying coil. In general, any configuration that permits the unobstructed vibration of the cantilever near a hard magnet is acceptable. FIG. 2A shows a preferred embodiment with the cantilever positioned between two hard magnets magnetized in opposite directions. This assembly resonates at a frequency varying directly with the thickness of the cantilever 20 and inversely with the length squared. The resulting vibration results in a time varying magnetic field B(x) in the cantilever at the cantilever resonance (FIG. 2B). The net change in flux ($\phi$) with time, (t), $d\phi/dt$, is easily sensed by a pickup coil (e.g., coil 4 shown in FIG. 1). The cantilever should preferably have a predetermined size (e.g., 0.2–2 cm in length, 0.1–0.5 cm in width, and 1–20 mils thick) so that the magnetic moment of the cantilever does not become too small and hence unable to produce a detectable magnetic signal. However, at present, Metglas™ is available in a very limited range of thicknesses and therefore cantilevers using this material can only be adjusted by varying their length. This limitation does not extend to permalloy or mu-metal.

Figure 3A:
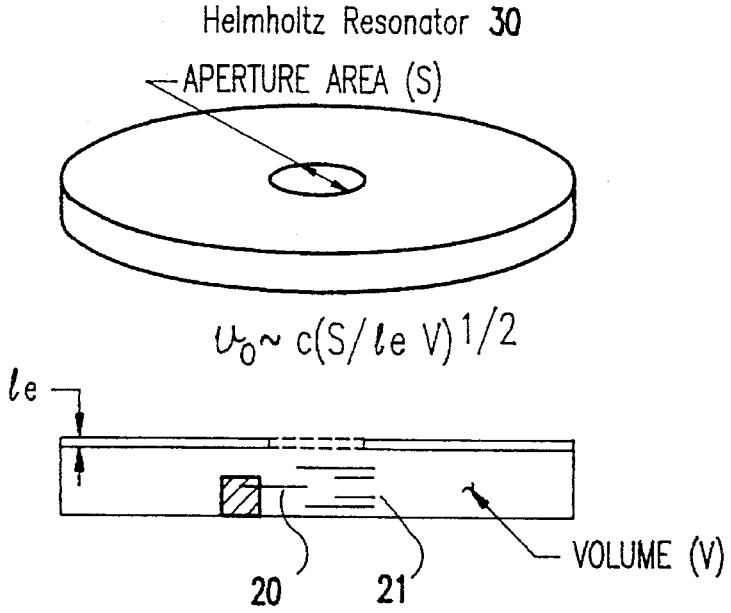
FIG. 3A illustrates a cantilever assembly positioned in a Helmholtz resonator.

The magnitude of the magnetic signal can be greatly enhanced by placing the cantilever element 20 inside of a Helmholtz resonator 30, as shown in FIG. 3A. For a set of cantilevers, the dimensions of the resonator are preferably chosen for a cavity resonance equal to that of the average frequency of the cantilever array. If the cantilever is mounted against one of the walls of the cavity of the resonator, the cantilever vibration amplitude is substantially enhanced by virtue of the resonance of the cavity.

Experimentally, cantilever resonances have been observed in the frequency range of 0.25 kHz–2.5 kHz. However, it is envisioned that these are not limiting upper or lower frequencies.

Figure 3B:
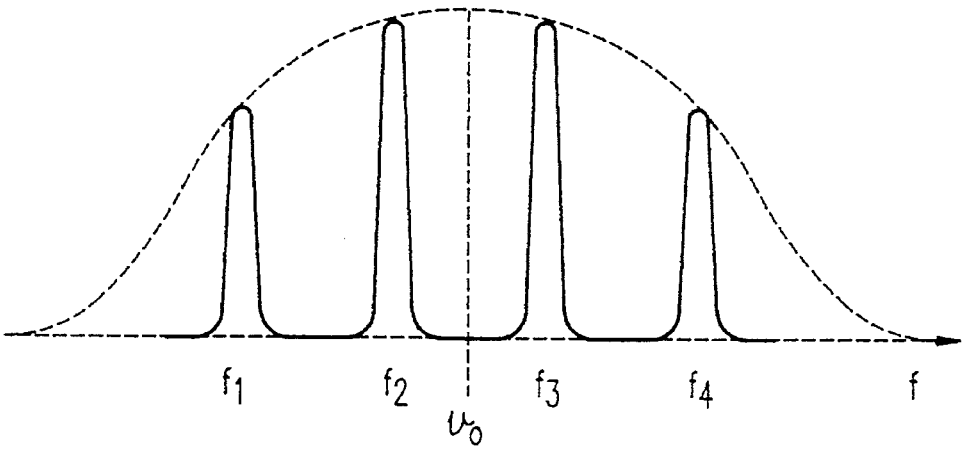
FIG. 3B is a graph illustrating the expected response of an array (e.g., four) of cantilevers mounted inside the Helmholtz resonator having a resonant frequency of $\upsilon_0$.
Figure 4:
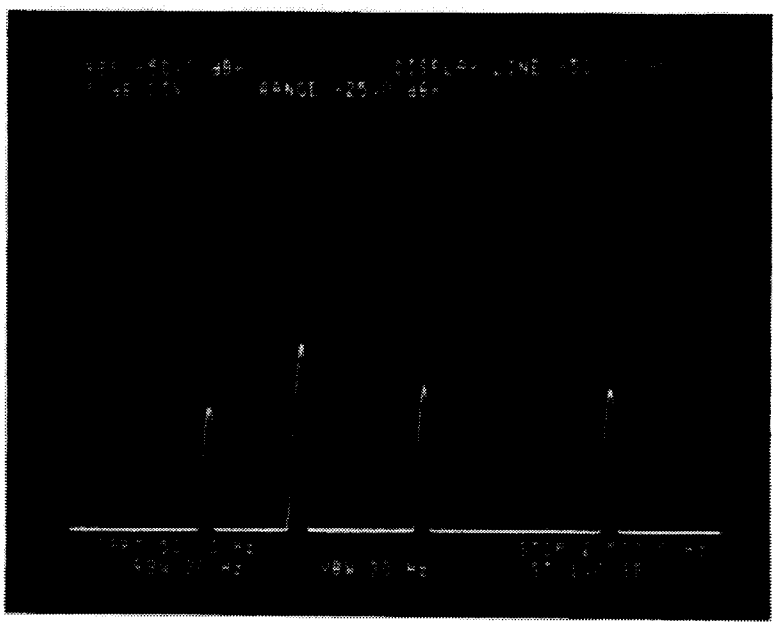
FIG. 4 illustrates the output of the frequency analyzer showing the response of a multielement cantilever tag to four speakers radiating simultaneously at different frequencies.

FIG. 3B is a graph illustrating the resonant frequency of the cantilever and more particularly the measured response of an array (e.g., four) of cantilevers mounted inside Helmholtz resonator 30 having a resonant frequency of $\upsilon_0$. FIG. 4 illustrates the output of the frequency analyzer 7 (e.g., see FIG. 1) showing the response of the tag to four speakers 3 radiating simultaneously at different frequencies.

The present inventors have built a plurality of cantilevers described above and they are operable as theory predicts. Their frequency is determined by their length, and the strength of the magnetic interaction produced by acoustic excitation is enhanced through the use of a resonator (e.g., a Helmholtz resonator). Further, in a multibit tag with a plurality of different cantilevers mounted within a single resonant cavity, each frequency can be uniquely excited and detected.

The Helmholtz resonance cavity is effective because it has a much lower Q than the cantilevers. Here, Q is the quality factor which is $\upsilon_0/\Delta\upsilon$ where $\upsilon_0$ is the center frequency and $\Delta\upsilon$ is the frequency spread at half maximum acoustic amplitude. Thus, one cavity can enhance the vibration of a plurality of cantilever frequencies. For large arrays, a few separate cavities can be employed. Clearly, the number of bits can be extended beyond 3 or 4, for example, by simply adding more cantilevers and by using additional acoustic sources to cause them to resonate.

Due to the magnitude of the displacement as well as to the non-linearity caused by the hysteresis curve of the magnetic material of the cantilever, higher RF harmonic (e.g., second) frequencies will be generated from each of the individual vibrating arms. Then, the information or code from the tag can be sensed by detecting the presence or absence of the fundamental or known higher harmonic frequencies by a pickup or receiving coil. Such a coil is known in the art and will not be described herein in detail. As mentioned above, the number of arms/cantilevers in the array will determine the number of information bits possible to be stored to provide information regarding the object associated with the tag structure.

In another embodiment of the present invention, the present inventors have found that the upper range of frequencies (e.g., 2.5 kHz) of the acousto-magnetic tag can be extended by utilizing different boundary conditions on a resonating strip (usually a "soft" magnetic material such as, for example, Ni—Co—B—Si) compared to those imposed by a cantilever configuration. The solution to the differential equations for the fundamental resonant frequency of a thin strip (bar) clamped at both ends, such as in FIG. 5, or unclamped at both ends, such as in FIG. 6, is identical and is approximately 6.4 times higher than that of a cantilever of equivalent length and equal thickness. In the unclamped case, the soft magnetic strip 61 is a free bar or is loosely supported, for example by positioning its ends in grooves or slots in a simple support structure at each end.

Thus, with these boundary conditions, the structure will have frequencies that are readily moved out of the range of human hearing, an advantage for use in any customer/retail environment. Simultaneously, relatively large lengths of the strips will ensure relatively large magnetic signals.

Similarly to the cantilever structures described above, the strip/bar structures also require a surrounding inhomogeneous magnetic field to provide a constant magnetic bias. These fields may be supplied by thin strips of high permeability material preferably mounted on either side of the resonant strip or bar.

Figure 5:
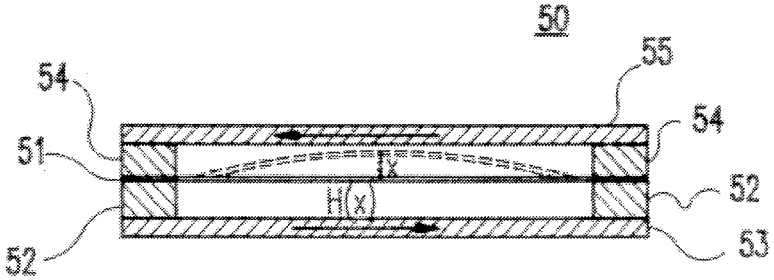
FIG. 5 illustrates a tag according to another aspect of the present invention having a Metglas™ or other soft magnetic material element with first and second ends thereof clamped and for excitation by acoustic energy.
Figure 6:
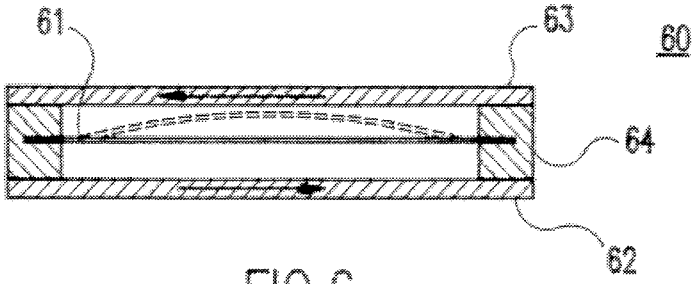
FIG. 6 illustrates a variation of the tag of FIG. 5 having both ends unclamped within slots for holding said element.

The tag 50 according to this aspect of the invention is preferably constructed as shown in FIG. 5 for high frequency applications. For the sake of convenience, tag 50 is shown as a single bit. A soft magnetic strip 51 is clamped at both ends by two supports 52 which also act as spacers to separate the strip from a hard magnet strip 53. In the preferred embodiment, an additional set of supports/spacers 54 are used to position a second hard magnet 55, preferably of opposite polarity as shown.

For the unclamped embodiment, the soft magnetic strip 61 is supported by the spacers, but not clamped (i.e., mechanically attached) to them. This can also be effected by the use of slotted spacers 64 shown in FIG. 6. The preferred embodiment with two oppositely polarized hard magnets, 62 and 63, is shown here. Typical dimensions of the soft magnetic material, for example Metglas™, are 1 cm length, 3 mm width and 25 μm thickness. The hard magnet can be iron foil, about 200 μm in thickness. A plurality of parallel strips can be configured to provide a multiplicity of bits, each strip having a different length and/or width to provide a unique set of fundamental and overtone frequencies. Providing a plurality of such strips is preferred so as to produce a multibit tag.

The entire assembly is preferably excited with acoustic waves from a known device, with the waves ranging in frequencies up to approximately 50 kHz and preferably in the range of 5–50 kHz. The upper frequency limit is due not primarily to the device, but by the ability of presently available speakers to be excited. The magnetic signal is somewhat enhanced by use of a Helmholtz resonator at lower frequencies such as 0.2–3 kHz.

Using acoustic frequencies out of the human hearing range is particularly attractive since it will not disturb people within the tag excitation area. Also, the extension to high frequencies makes it possible to increase the number of soft magnetic strips, and hence the number of unique frequencies or bits within this greatly increased bandwidth range.

With the invention, based on the detected frequency code generated by the tag, decoding or interpretation of the code can be accomplished by a suitable decoding device 8 as shown in FIG. 1 which is known in the art and which includes, for example, an interface between the coil 4 and a suitable processor including such known circuitry as an A/D converter, suitable signal condition/processing circuitry, lookup tables and logic circuitry.

In the case of a multibit tag, a digital tag can be made and the logic circuitry can be programmed to detect the digital code. In the binary case, if a certain resonant frequency of an array of cantilevers is found it can be assigned a value of "zero" or "one" and, if absent, it can take the opposite value. One way to create a "zero" is to remove or not provide a cantilever corresponding to the frequency to be searched for. Another way would be to destroy the magnetic or mechanical properties of the cantilever. Such multibit tags having a distinct digital code (e.g., a binary code) are sometimes referred to as programmed or personalized tags.

Other methods of interrogating the tags include applying a set of acoustic frequencies corresponding to the resonating frequencies in a "chirp" or multiplexing fashion to cause each resonator present within the tag to vibrate in a temporal sequence. Alternatively, the excitation fields can be electromagnetic in nature, i.e., an ac magnetic field, and the detection can be acoustic or magnetic. The frequencies can be applied by frequency generators coupled to the excitation device (e.g., speakers, AC excitation coil, and/or AC and DC excitation coil). With either form of excitation, the magnetic material oscillates within the stronger inhomogeneous bias field.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A magnetic tag for being remotely sensed, comprising:

at least one soft magnetic element mounted for being excited in an inhomogeneous magnetic field, said at least one soft magnetic element having first and second ends and being clamped at at least one of said first and second ends, wherein no part of said at least one soft magnetic element other than said at least one of said first and second ends is clamped, each said at least one soft magnetic element responding to said excitation to produce a unique, time-varying magnetic field corresponding to its resonant frequency, when excited by an energy field which includes at least one distinct frequency corresponding to the resonant frequency of said magnetic element.

2. A magnetic tag as in claim 1 wherein said excitation is magnetic.

3. A magnetic tag as in claim 1 wherein said excitation is acoustic.

4. A magnetic tag as in claim 1, wherein said inhomogeneous magnetic field is provided by at least one element of a hard magnetic material in close proximity to said at least one soft magnetic element.

5. A magnetic tag as in claim 1 wherein said inhomogeneous magnetic field is provided by a magnetic field external to said tag.

6. A magnetic tag as in claim 1, wherein a plurality of soft magnetic elements for being excited in an inhomogeneous magnetic field are provided, and wherein the presence or absence of a predefined resonant frequency associated with at least one soft magnetic element of said plurality of soft magnetic elements constitutes a code.

7. A magnetic tag for being remotely sensed, comprising:

at least one soft magnetic element mounted for being acoustically excited in an inhomogeneous magnetic field, each said at least one soft magnetic element vibrating at its respective resonant frequency to produce a unique, time-varying magnetic field corresponding to said resonant frequency, when excited by acoustic excitation, said at least one soft magnetic element being mounted within a Helmholtz resonator.

8. A magnetic tag as in claim 7 wherein said inhomogeneous magnetic field is provided by at least one element of a hard magnetic material in close proximity to said at least one soft magnetic element.

9. A magnetic tag as in claim 7 wherein said inhomogeneous magnetic field is provided by a magnetic field external to said tag.

10. A tag as in claim 7 wherein said each of said at least one soft magnetic element has first and second ends and wherein one of said first or second ends of each of said at least one soft magnetic element is clamped thereby forming a cantilever.

11. A magnetic tag as in claim 7, wherein a plurality of soft magnetic elements tier being excited in an inhomogeneous magnetic field are provided, and wherein the presence or absence of a predefined resonant frequency associated with at least one soft magnetic element of said plurality of soft magnetic elements constitutes a code.

12. A magnetic tag as in claim 1 or 7 wherein said at least one soft magnetic element has first and second ends and wherein both of said first and second ends are clamped.

13. A magnetic tag as in claim 1 or 7 wherein said at least one element is formed of an amorphous material formed as a strip having predetermined fundamental and overtone frequencies which are determined by its length, width, thickness and boundary conditions, wherein said excitation produces mechanical vibrations in said strip which cause a change in magnetization of said strip, said change being detected as a magnetic signal in a pickup coil.

14. A magnetic tag for being remotely sensed, comprising:

at least one soft magnetic element mounted for being excited in an inhomogeneous magnetic field, each said at least one soft magnetic element responding to said excitation to produce a unique, time-varying magnetic field corresponding to its resonant frequency, when excited by said excitation, wherein the tag is mounted in a Helmholtz resonator.

15. A system for identifying an object, comprising:

a magnetic tag for attachment to said object and for identification of said object upon being interrogated, said magnetic tag including at least one element of a soft magnetic material and having predetermined fundamental and overtone frequencies, said at least one element of soft magnetic material having first and second ends and being clamped at at least one of said first and second ends, wherein no part of said at least one element of soft magnetic material other than said at least one of said first and second ends is clamped;

means for exciting said magnetic tag thereby to excite said at least one element of soft magnetic material to cause said soft magnetic element to mechanically vibrate; and means for detecting the mechanical vibrations of said soft magnetic element.

16. A system according to claim 15, further comprising means for receiving an output from said means for detecting, and for decoding said output, thereby to identify said object.

17. A system according to claim 15, wherein said excitation is magnetic and said means for detecting comprise either acoustic or magnetic detection means.

18. A system according to claim 15, wherein said excitation is acoustic and said means for detecting comprise acoustic means or means for detecting changes in magnetic flux caused by said mechanical vibrations.

19. A multibit magnetic tag for being remotely sensed, comprising:

a plurality of soft magnetic elements mounted for being excited in an inhomogeneous magnetic field, each soft magnetic element of said plurality of soft magnetic elements having first and second ends and being clamped at at least one of said first and second ends, wherein no part of said each soft magnetic element other than said at least one of said first and second ends is clamped, each of said soft magnetic elements responding to said excitation to produce a unique, time-varying magnetic field corresponding to its resonant frequency, when excited by said excitation.

20. A multibit magnetic tag according to claim 19, wherein the tag is mounted in a Helmholtz resonator.

* * * * *